US010923266B2

(12) United States Patent
Ryu

(10) Patent No.: US 10,923,266 B2
(45) Date of Patent: Feb. 16, 2021

(54) COIL COMPONENT

(71) Applicant: SAMSUNG ELECTRO-MECHANICS CO., LTD., Suwon-Si (KR)

(72) Inventor: Joung Gul Ryu, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 215 days.

(21) Appl. No.: 16/119,998

(22) Filed: Aug. 31, 2018

(65) Prior Publication Data

US 2019/0279807 A1 Sep. 12, 2019

(30) Foreign Application Priority Data

Mar. 8, 2018 (KR) ..... 10-2018-0027435

(51) Int. Cl.

| | |
|---|---|
| ***H01F 27/28*** | (2006.01) |
| ***H01F 27/29*** | (2006.01) |
| ***H01F 41/04*** | (2006.01) |
| ***H01F 41/12*** | (2006.01) |
| ***H01F 27/32*** | (2006.01) |

(Continued)

(52) U.S. Cl.

CPC ..... *H01F 27/2804* (2013.01); *H01F 17/0013* (2013.01); *H01F 17/04* (2013.01); *H01F 27/29* (2013.01); *H01F 27/292* (2013.01); *H01F 27/323* (2013.01); *H01F 41/041* (2013.01); *H01F 41/12* (2013.01); *H01F 2017/048* (2013.01); *H01F 2027/2809* (2013.01)

(58) Field of Classification Search

CPC ..... H01F 17/04; H01F 17/0013; H01F 2017/048; H01F 2027/2809; H01F 41/12; H01F 41/041

USPC ..... 336/200, 223, 233

See application file for complete search history.

(56) References Cited

U.S. PATENT DOCUMENTS

2004/0164835 A1* 8/2004 Shoji ..... H01F 17/0013 336/200
2009/0029185 A1* 1/2009 Lee ..... H01F 41/046 428/573

(Continued)

FOREIGN PATENT DOCUMENTS

JP 2004111597 A * 4/2004
KR 10-1995-0003861 4/1995

(Continued)

*Primary Examiner* — Mang Tin Bik Lian

(74) *Attorney, Agent, or Firm* — Morgan, Lewis & Bockius LLP

(57) ABSTRACT

A coil component includes a body including a support member having a through hole and a via hole, first and second coils disposed on first and second sides of the support member opposing each other and having coil patterns, and a magnetic material sealing the support member and the coil, and an external electrode disposed on an exterior surface of the body. The first coil includes at least a portion embedded in the support member, and a second coil is connected to the first coil through a via filling an interior of the via hole. Groove portions, recessed toward a center of the support member according to a shape of the first coil, are filled with a first conductive layer as a lowermost layer of the first coil. The second side of the support member is in contact with a lower surface of the second coil.

20 Claims, 11 Drawing Sheets

(51) Int. Cl.
*H01F 17/00* (2006.01)
*H01F 17/04* (2006.01)

(56) References Cited

U.S. PATENT DOCUMENTS

2013/0038417 A1* 2/2013 Kim ..... H01F 17/0013
336/192
2013/0222101 A1* 8/2013 Ito ..... H01F 5/003
336/83
2013/0300529 A1* 11/2013 Chang ..... H01F 27/292
336/173
2015/0035634 A1* 2/2015 Nakamura ..... H01F 41/046
336/170
2015/0340149 A1* 11/2015 Lee ..... H05K 1/165
174/260

FOREIGN PATENT DOCUMENTS

KR 10-1999-0066108 A 8/1999
KR 10-2009-0064660 A 6/2009

* cited by examiner

COIL COMPONENT

CROSS-REFERENCE TO RELATED APPLICATION

This application claims the benefit of priority to Korean Patent Application No. 10-2018-0027435, filed on Mar. 8, 2018 with the Korean Intellectual Property Office, the entirety of which is incorporated herein by reference.

TECHNICAL FIELD

The present disclosure relates to a coil component, and more particularly, to a thin film power inductor including a support member.

BACKGROUND

Along with the development of IT technology, the miniaturization and thinning of devices are accelerating, and market demand for small and thin devices is also increasing.

In Patent Document 1 (Korea Patent Laid-Open Publication No. 10-1999-0066108), to meet requirements of this technological trend, a power inductor, including a substrate having a via hole, and coils, disposed in both sides of the substrate and electrically connected through the via hole of the substrate, is provided, thereby attempting to provide an inductor including a coil, which is uniform and has a high aspect ratio. However, due to limitations in a manufacturing process, and the like, there is a limit to the formation of a coil, which is uniform and has a high aspect ratio.

SUMMARY

An aspect of the present disclosure provides a coil component capable of solving a problem of alignment mismatch between a plated layer and a seed layer in a coil pattern having a fine line width when a coil pattern having a high aspect ratio is formed through anisotropic plating.

According to an aspect of the present disclosure, a coil component includes a body including a support member having a through hole and a via hole, first and second coils disposed on a first side of the support member and a second side of the support member opposing the first side and having a plurality of coil patterns, respectively, and a magnetic material sealing the support member and the coil, and an external electrode disposed on an exterior surface of the body. The first coil includes at least a portion embedded in the support member, and the second coil is connected to the first coil through a via filling an interior of the via hole. The first side of the support member includes groove portions recessed toward a center of the support member according to a shape of the coil, and the groove portions are filled with a first conductive layer as a lowermost layer of the first coil. The second side of the support member is in contact with a lower surface of the second coil.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
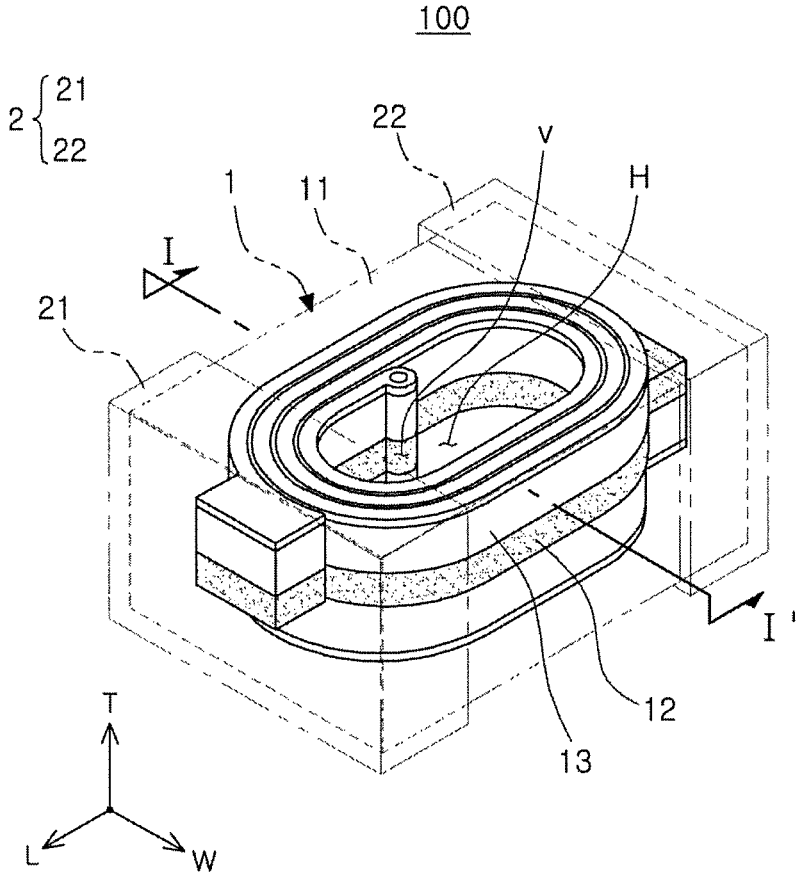
FIG. 1 is a schematic perspective view of an inductor according to a first example.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being 'on,' 'connected to,' or 'coupled to' another element, it can be directly 'on,' 'connected to,' or 'coupled to' the other element or other elements intervening therebetween may be present. In contrast, when an element is referred to as being 'directly on,' 'directly connected to,' or 'directly coupled to' another element, there may be no other elements or layers intervening therebetween. Like numerals refer to like elements throughout. As used herein, the term 'and/or' includes any and all combinations of one or more of the associated listed items.

It will be apparent that although the terms first, second, third, etc. may be used herein to describe various members, components, regions, layers and/or sections, any such members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as 'above,' 'upper,' 'below,' and 'lower' and the like, may be used herein for ease of description to describe one element's relationship relative to another element(s) as shown in the figures. It will be understood that spatially relative terms are intended to encompass different orientations of the device in use or operation, in addition to the orientation depicted in the figures. For example, if the device in the figures is turned over, elements described as 'above,' or 'upper' relative to other elements would then be oriented 'below,' or 'lower' relative to the other elements or features. Thus, the term 'above' can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms 'a,' 'an,' and 'the' are intended to include the plural forms as well, unless the context clearly indicates otherwise. It will be further understood that the terms 'comprises,' and/or 'comprising,' when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted alone, in combination or in partial combination.

The contents of the present disclosure described below may have a variety of configurations and propose only a required configuration herein, but are not limited thereto.

Hereinafter, a coil component according to an exemplary embodiment will be described, but an exemplary embodiment is not limited thereto.

Figure 2:
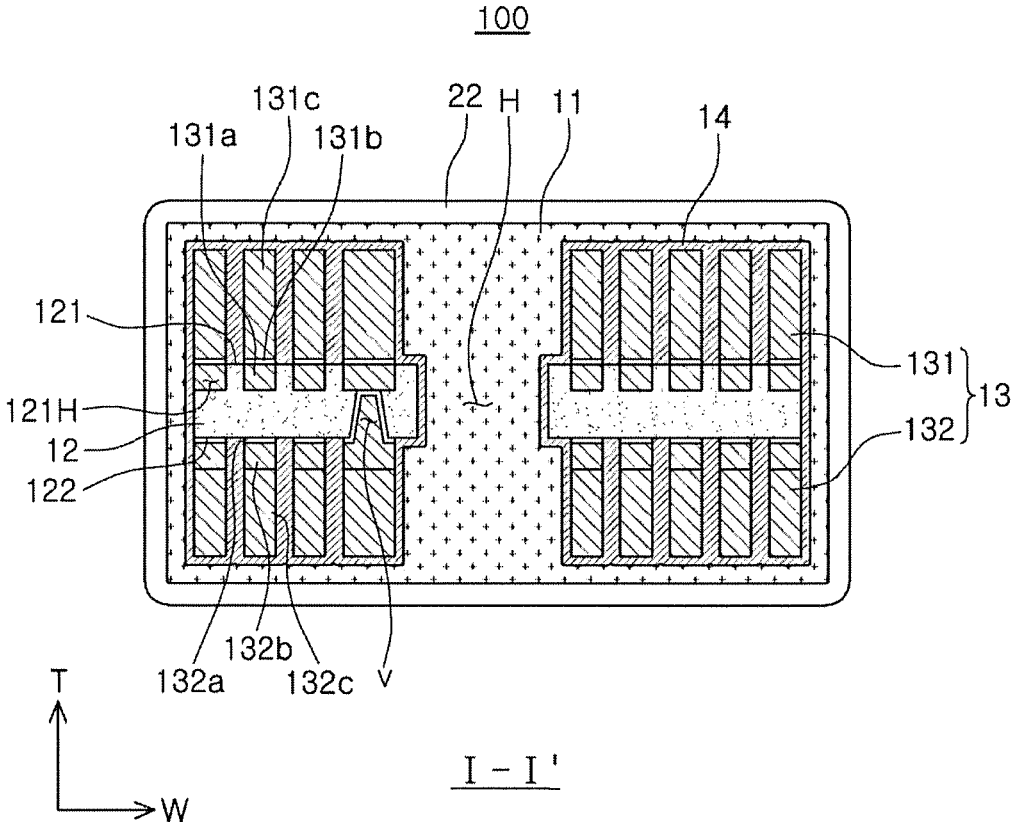
FIG. 2 is a cross-sectional view taken along line I-I' of FIG. 1.

FIG. 1 is a schematic perspective view of an inductor according to a first example, and FIG. 2 is a cross-sectional view cut along line I-I' of FIG. 1.

Referring to FIGS. 1 and 2, an inductor 100 includes a body 1 and an external electrode 2 disposed on an exterior surface of the body.

The external electrode 2 is preferably formed of a material having excellent electrical conductivity, and may be formed of a plurality of layers. A portion of the plurality of layers may be formed of a conductive resin layer.

The body 1 may substantially form an outer cover of the inductor, and may have a substantially hexahedral shape by including an upper surface and a lower surface, opposing in a direction of a thickness T, a first end surface and a second end surface, opposing in a direction of a length L, as well as a first side surface and a second side surface, opposing in a direction of a width W.

The body 1 includes a magnetic material 11, and the magnetic material may be applied without limitations as long as it has magnetic properties. For example, a resin may be filled with ferrite or metal magnetic particles, and the metal magnetic particles may include one or more selected from the group consisting of iron (Fe), silicon (Si), chromium (Cr), aluminum (Al), and nickel (Cr).

The magnetic material may serve to seal a support member 12, which will be described later, and a coil 13 supported by the support member.

The support member 12, sealed by the magnetic material, may serve to support a coil, and may serve to allow a coil to be more easily formed. The support member 12 may be appropriately selected by those skilled in the art, under the conditions of having rigidity suitable for supporting the coil, and including a material having insulating properties, and may preferably have a shape of a thin plate. The support member 12 may be, for example, a central core of a known copper clad laminate (CCL), may be a photoimagable dielectric (PID) resin or Ajinomoto build-up film (ABF), and may have a structure in which a prepreg, a glass fiber, or the like, is impregnated in a thin insulating resin.

The support member 12 may include a through hole H and a via hole v, spaced apart from the through hole. A form of each of the through hole H and the via hole is not limited as long as each of the through hole H and the via hole is configured to pass through the support member 12. An interior of the through hole H is preferably filled with a magnetic material. The interior of the through hole H is filled with a magnetic material, so the permeability of the coil component may be significantly improved. The interior of the via hole is preferably filled with a conductive material. In this case, a first second coil and a second coil, disposed on one side 121 and the other side 122 of the support member 12, respectively, may be electrically connected to each other.

One side 121 of the support member 12 and the other side 122 thereof, opposing one side 121, may include different interfaces. One side 121 may include a plurality of groove portions 121H etched toward the center of the support member 12 according to a shape of the coil. A depth of the groove portion 121H may be appropriately selected by those skilled in the art. In this case, it is preferable to consider the degree of stiffness, at which the support member is able to support the coil, after a groove portion 121H is formed.

The other side 122 of the support member 12 is configured to have a substantially flat shape, in a manner different from one side 121. Here, having the substantially flat shape refers to having a plate shape or a state in which a separate treatment is not applied to the other side 122 of the support member 12, rather than controlling surface roughness occurring during a process.

Meanwhile, a first coil 131 is disposed on one side 121 of the support member 12. The first coil 131 may have a stacked structure in which a plurality of layers are stacked. A first conductive layer 131*a* of the first coil 131, disposed at a lowermost portion of the plurality of layers and formed on one side 121, fills an interior of a groove portion 121H formed on one side 121 of the support member 12. A cross-section of the first conductive layer 131*a* has a shape corresponding to that of a cross-section of the groove portion 121H, for example, a quadrangular or tapered shape, but an exemplary embodiment is not limited thereto. A thickness of the first conductive layer 131*a* may be about 20 μm, but an exemplary embodiment is not limited thereto. The thickness of the first conductive layer 131*a* may be appropriately selected in consideration of a thickness of the support member 12, rigidity of a material, or the like.

The first conductive layer 131*a* is configured to be directly in contact with the support member 12. Here, directly contacting indicates that a first conductive layer, containing a conductive material, and the support member 12, are in direct contact with each other without a separate insulating material or insulating coating layer being interposed therebetween. Thus, the support member 12 preferably includes an insulating material to prevent a short with the conductive material of the first conductive layer from occurring.

A second conductive layer 131*b* of the first coil 131 is disposed on the first conductive layer 131*a*, and the second conductive layer 131*b* is a thin layer, which is thinner as compared with the first conductive layer 131*a*. The first conductive layer 131*a* and the second conductive layer 131*b* are formed of a material having excellent electrical conductivity, and may be formed of different materials. For example, the first conductive layer 131*a* includes copper (Cu), while the second conductive layer 131*b* may include nickel (Ni), palladium (Pd), molybdenum (Mo), aluminum (Al), tungsten (W), or the like. A thickness of the second conductive layer 131*b* is not limited, and may preferably be about equal to or more than 50 nm and equal to or less than 1 μm. If the thickness of the second conductor layer 131*b* is thinner than 50 nm, it may be difficult to control a uniform thickness during a process. If the thickness of the second conductor layer 131*b* is thicker than 1 μm, when a portion is removed to prevent a short between adjacent coil patterns from occurring during a process, it may be difficult to remove the portion.

Moreover, a third conductive layer 131*c* of the first coil 131 substantially determining a thickness of a coil pattern in the first coil 131 may be disposed on the second conductive layer 131*b*. A shape of a cross-section of the third conductive layer 131*c* may be a rectangular shape. In this case, an upper surface of the third conductive layer 131*c* may be adjusted to have a concave shape, a convex shape, or a flat shape.

A surface of the first coil 131, having a stacked structure of the first to third conductive layers 131*a* to 131*c*, may be coated with an insulating material 14. In this case, the insulating material 14 may be applied without limitations as long as it has insulating properties, and may include, for example, a perylene resin or epoxy resin.

Next, a second coil 132, electrically connected to the first coil 131, will be described. The second coil 132 is formed on the other side 122 of the support member 12. A lowermost layer of the second coil 132 may be formed to be coplanar with the other side 122 of the support member 12, in a manner different from the first coil. In other words, at least a portion of the first coil 131 is embedded in the support member 12, while the second coil 132 is formed on a surface of the support member 12.

The second coil 132 also has a stacked structure, in which a plurality of conductive layers are stacked, in a manner similar to the first coil. A lowermost layer of the second coil 132 is a fourth conductive layer 132*a*, in contact with the other side 122 of the support member 12, and the fourth conductive layer 132*a* extend to at least a portion of a side surface of the via hole v of the support member 12. A thickness of the fourth conductive layer 132*a* is preferably from 50 nm to 1 μm. A material of the fourth conductive layer 132*a* is applied without limitations as long as it has excellent electrical conductivity. However, selection of a metal sputtering method is advantageous for formation of a metal layer, a thin film having a nanoscale thickness, during a process. For this reason, a metal, to which metal sputtering is able to be applied, such as Ni, Al, Mo, W, Pd, or the like, may be contained therein.

A fifth conductive layer 132*b* of the second coil 132, formed using the fourth conductive layer 132*a* as a seed layer, is disposed on the fourth conductive layer 132*a*. The fifth conductive layer 132*b* is a conductive layer, thicker than the fourth conductive layer 132*a*, and a material of the fifth conductive layer 132*b* may be different from that of the fourth conductive layer 132*a*, and may include, for example, copper (Cu).

A sixth conductive layer 132*c* of the second coil 132 is included on the fifth conductive layer 132*b*, and the sixth conductive layer 132*c* may determine a substantial thickness of the second coil. A thickness of the sixth conductive layer 132*c* may be appropriately selected by those skilled in the art, and the first coil 131 and the second coil 132 may be adjusted to have substantially the same thickness, by adjusting a thickness of the sixth conductive layer 132*c*.

A surface of the second coil 132 having a stacked structure of the fourth to sixth conductive layers 132*a* to 132*c* may be coated with an insulating material. In this case, the insulating material may be applied without limitations as long as it has insulating properties, and may include, for example, a perylene resin, epoxy resin, or the like. The insulating material, formed on the second coil, may be formed simultaneously with the insulating material 14, formed on the first coil, so the insulating materials may be integrally configured. A method for forming the insulating material is not limited. However, when a chemical vapor deposition method is used, an interior surface of a through hole of the support member 12 may be also coated with the insulating material.

At least a portion of the first coil is embedded in the support member, so a thickness of a coil pattern in a miniaturized chip size may be significantly reduced. Moreover, a coil is formed using the first conductive layer, embedded in the support member, as a seed pattern, so it may be easy to adjust alignment of a coil pattern. In detail, when a first conductive layer, serving as a seed pattern, is embedded in the support member, after an insulating material is laminated on the support member, another conductive layer is formed on a first conductive layer through exposure and development of an opening. In this case, even when a remaining insulating material is disposed on at least a portion of a surface of the first conductive layer, an alignment defect of a coil pattern does not occur or an alignment error is reduced.

Moreover, at least a portion of the first coil is embedded in a support member, so low-profile, reducing a thickness of a chip size of the entirety of the coil component based on a thickness of the same coil pattern, may be possible.

At least a portion of the first coil is embedded in the support member based on a coil component having the same thickness, so the overall thickness of an insulating layer may be adjusted to be thin. In this regard, a path of magnetic flux becomes shortened, and a filling thickness of a magnetic material in upper and lower portions of a coil may be relatively increased. As a result, the capacity increases due to a decrease in length of a magnetic path and the magnetic flux density of a magnetic material in the upper and lower portions of a coil is reduced, so the DC-bias effect may be expected to be increased.

Moreover, when the first coil and the second coil are configured to have a stacked structure of a plurality of conductive layers, at least a single layer, a thin conductive layer is interposed therebetween, so the adhesion between the support member and the dry film resistor (DFR) film is increased, thereby preventing a short of a coil or delamination of the DFR film from occurring.

Figure 3A:
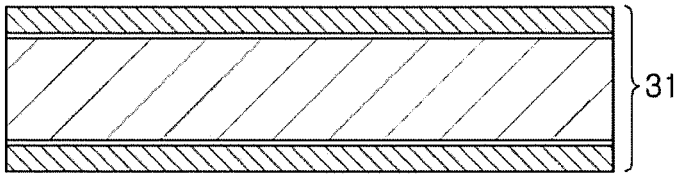
FIG. 3A-3O illustrate a schematic process for manufacturing the inductor according to the first example.
Figure 3B:
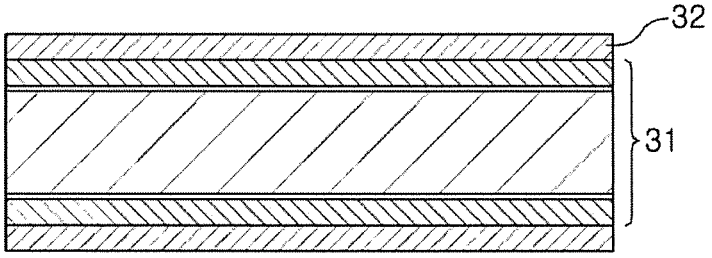
Figure 3C:
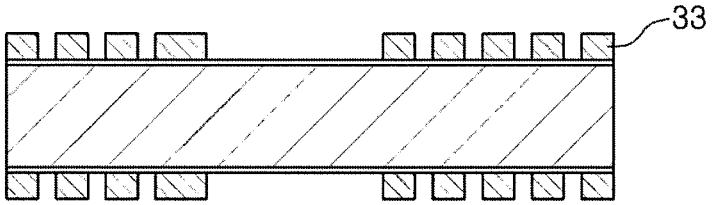
Figure 3D:
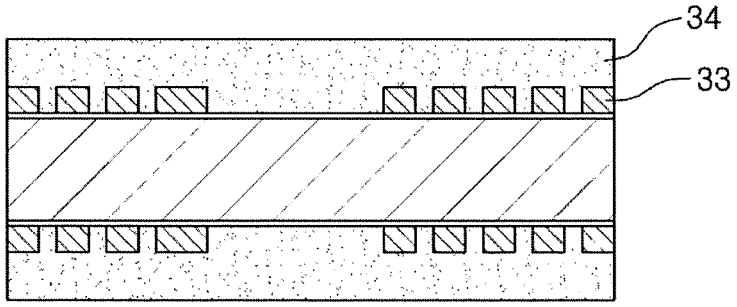
Figure 3E:
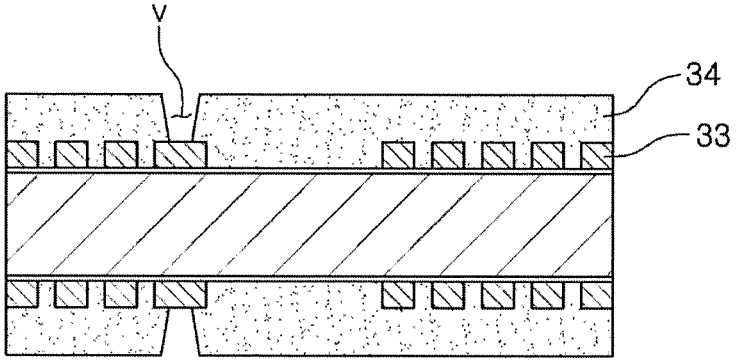
Figure 3F:
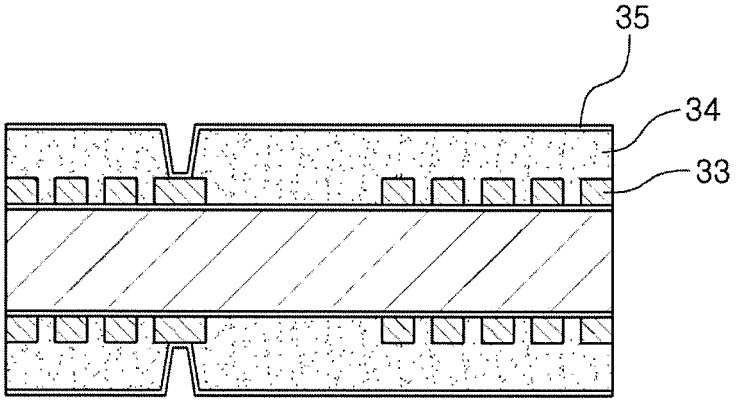
Figure 3G:
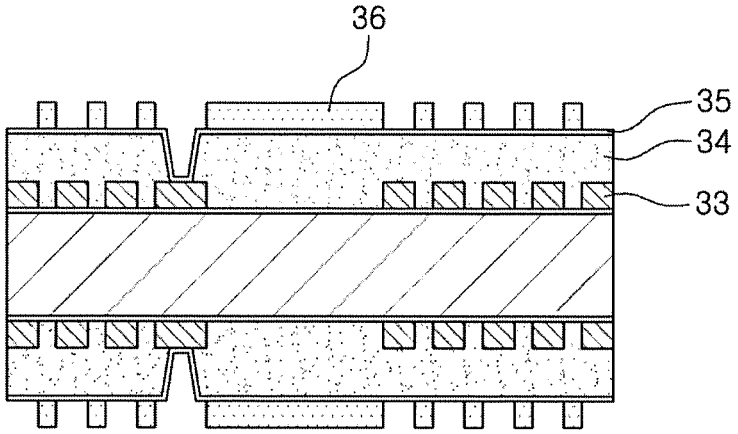
Figure 3H:
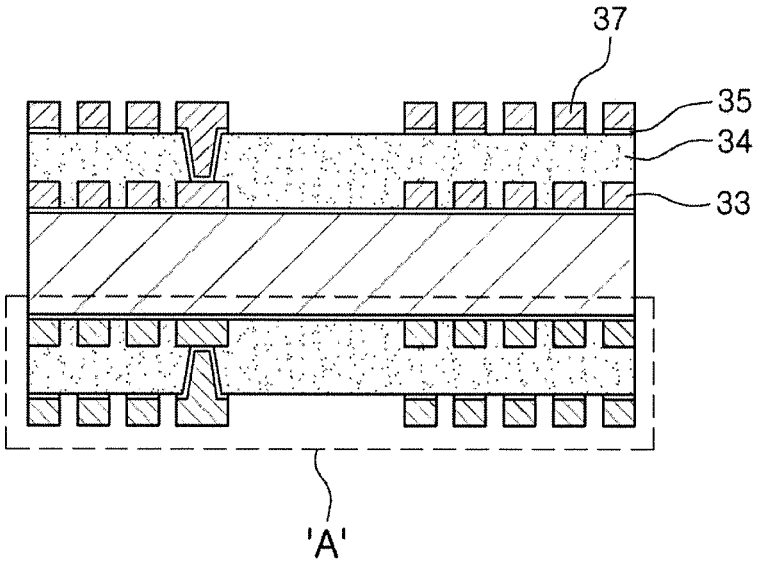
Figure 3I:
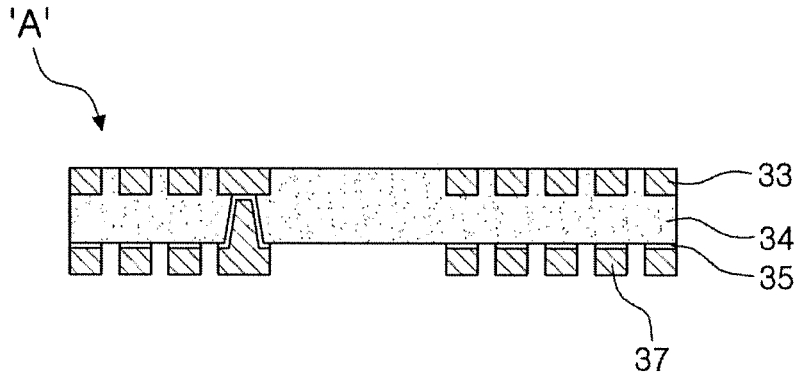
Figure 3J:
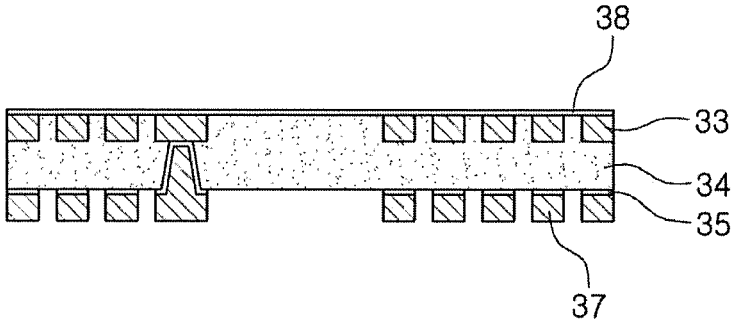
Figure 3K:
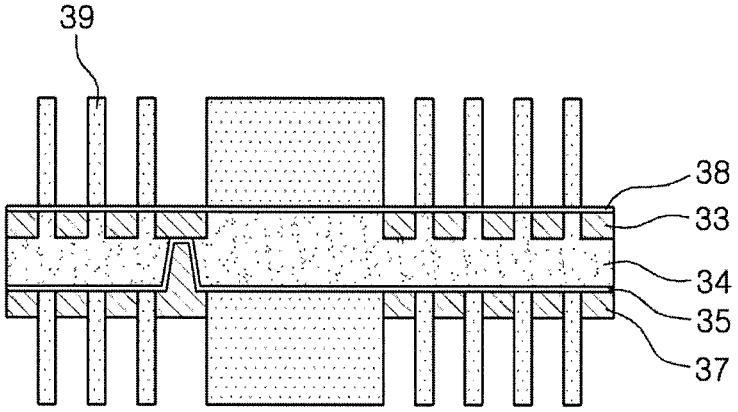
Figure 3L:
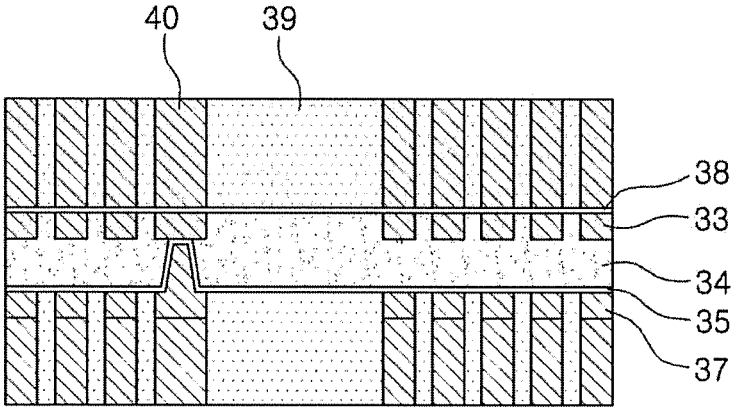
Figure 3M:
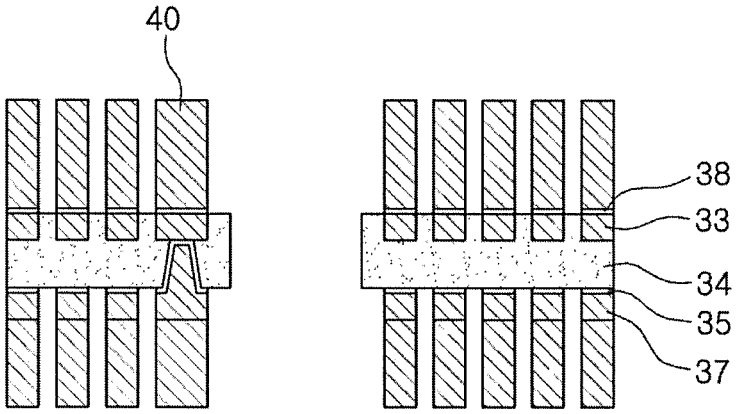
Figure 3N:
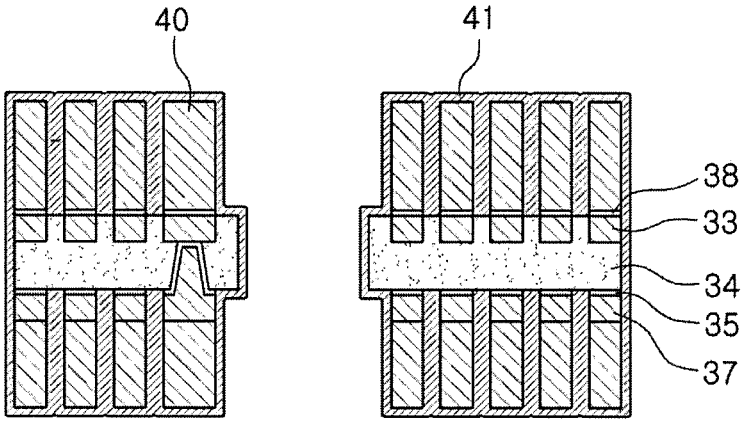
Figure 3O:
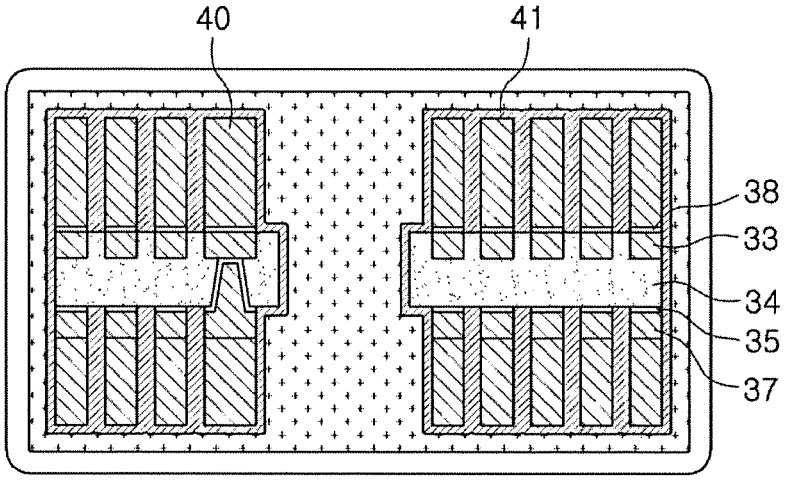

FIGS. 3A to 3O illustrate an example of a method for manufacturing a coil component according to a first example. The method for manufacturing a coil component according to a first example may be appropriately selected by those skilled in the art, and is not limited to the manufacturing method illustrated in FIGS. 3A to 3O. Meanwhile, for convenience of explanation, each operation will be described using separate reference numerals and separate terms from those of FIGS. 1 and 2.

FIG. 3A illustrates preparing a carrier substrate 31. It is preferable that copper foils are stacked on one side and the other side of the carrier substrate 31. A thickness of each of the copper foils may be appropriately selected by those skilled in the art, and may be about 20 μm.

Next, FIG. 3B illustrates laminating a dry film resistor (DFR) film 32 on an upper surface and a lower surface of the carrier substrate 31, and FIG. 3C illustrates patterning by exposure and development of the DFR film 32, forming a first conductor layer 33 by the patterning, and removing the DFR film 32.

FIG. 3D illustrates arranging an insulating material 34 to allow the first conductor layer 33 to be embedded using V-press. A method for arranging the insulating material 34 is not limited, and a method for stacking a film or sheet having insulating properties may be used.

Next, FIG. 3E illustrates forming a via hole v by removing a portion of the insulating material 34. Here, at least a portion of an upper surface of the first conductor layer 33, embedded by the insulating material 34, is exposed thereby. A method for forming the via hole v may be laser processing.

FIG. 3F illustrates forming the second conductor layer 35, a thin film, along a side surface of a via hole v and the entirety of an upper surface of the insulating material 34. In this case, the second conductor layer 35 serves as a seed pattern in a final coil component. A method for forming the second conductor layer 35 is not limited, but a metal sputtering method is preferably used for formation of a thin film of a nanoscale thin film.

FIG. 3G illustrates arranging a DFR film 36, having been patterned, on a surface, in which the second conductor layer 35, a thin film, is formed. The patterning is performed to have a shape corresponding to that of the first conductor layer 33, having been substantially provided already.

FIG. 3H illustrates forming a third conductor layer 37 in an opening of the DFR film 36, having been patterned, and removing the DFR film 36. When the third conductor layer 37 is provided, electric copper plating according to the related art may be used, and a via hole v is filled with the third conductor layer 37, so a via is substantially completed.

FIG. 3I illustrates separating the carrier substrate. Here, two coil portions may be formed from a single carrier substrate through the operation described above. The following description will be made with reference to a single coil portion A separated from the carrier substrate. After separating the coil portions from the carrier substrate, the insulating material 34 of the respective coil portion corresponds to a support member thereof.

FIG. 3J illustrates forming a fourth conductor layer 38 on the end surface of the coil portion A, having been exposed. In this case, a metal sputtering method is preferably used for formation of a fourth conductor layer 38 having a nanoscale thickness. Thus, the fourth conductor layer 38 may include various materials such as Ni, Pd, W, and the like, in addition to Cu, so a degree of freedom of selection of a material is high.

FIG. 3K illustrates forming an insulating wall 39 by patterning an insulating material. The insulating wall 39 is formed of an insulating resin containing epoxy. Moreover, a patterning method may be $CO_2$ laser, but an exemplary embodiment is not limited thereto. The insulating wall 39, having been patterned, includes an opening, and a surface of the fourth conductor layer 38 is exposed through the opening. Thus, the fourth conductor layer 38 may serve as a seed pattern of a fifth conductor layer 40 filling an opening of the insulating wall. When the insulating wall 39 is patterned, it is preferable that an opening of the insulating wall 39 and an upper surface of the fourth conductor layer 38 are exactly aligned. However, during the exposure of the insulating wall 38, even when alignment mismatch occurs due to a process error such as a certain level of eccentricity, or the like, a portion of a conductor layer is embedded in a support member. In this regard, as much as a line width of the coil pattern, having been embedded, a degree of freedom of alignment may increase.

FIG. 3L illustrates forming a fifth conductor layer 40 by filling an interior of the insulating wall 39, having been patterned. The fifth conductor layer 40 is desired to grow to a level lower than that of an upper surface of the insulating wall 39 or to a position the same as the upper surface of the insulating wall 39. If the fifth conductor layer 40 grows higher than the upper surface of the insulating wall 39, a short between fifth conductor layers, adjacent to each other, may occur. In this case, a polish process may be performed to remove an extra portion of the fifth conductor layer 40 to allow the upper surfaces of the fifth conductor layer 40 and the insulating layer 39 to be coplanar with each other, thereby avoiding the short.

FIG. 3M illustrates removing the insulating wall 39 through separation using a $CO_2$ laser or chemical solution. In addition, a portion of the insulating material 34 correspond to a through hole is removed to form the through hole in the insulating material 34. Subsequently, FIG. 3N illustrates forming an insulating coating 41 to insulate a surface of the coil pattern, having been exposed. In this case, the insulating coating 41 is preferably a resin having insulating properties, and may be a perylene resin for thin and uniform insulating coating.

FIG. 3O illustrates forming a coil component in the form of a chip, as a subsequent process, and illustrates finishing operations such as filing a magnetic material, exposing a coil lead-out portion, forming an external electrode, and the like.

Figure 4:
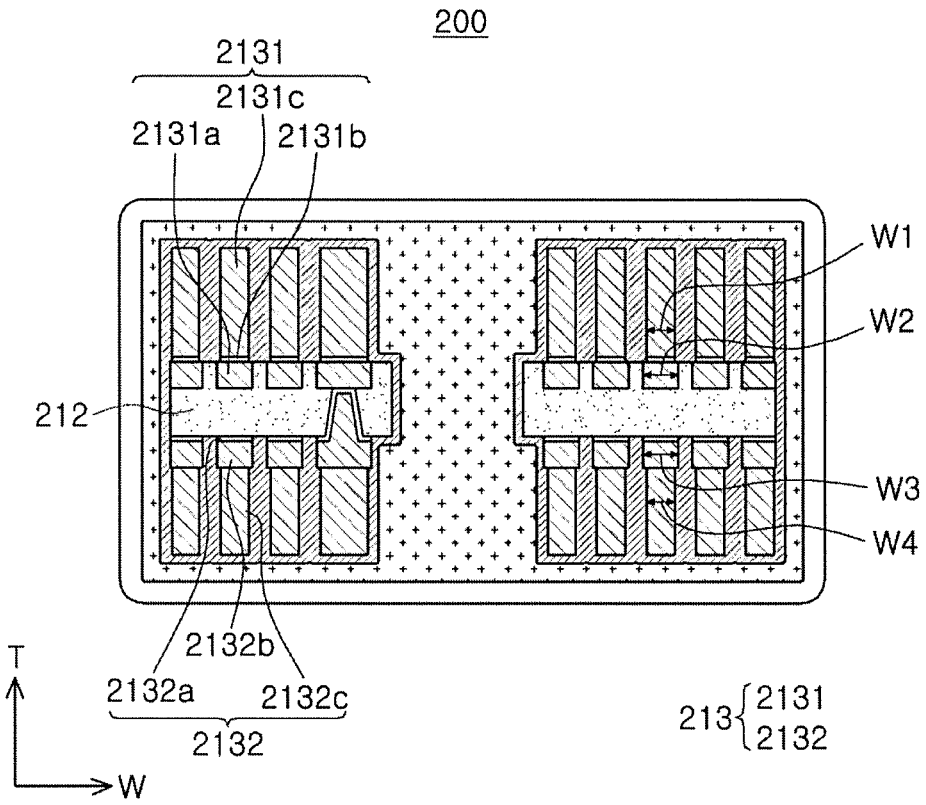
FIG. 4 is a cross-sectional view of an inductor according to a second example.

FIG. 4 is a schematic cross-sectional view of a coil component 200 according to a second example. The coil component 200 according to a second example may include components substantially the same as those of the coil component 100 according to the first example described with reference to FIGS. 1 and 2, except that line widths of respective layers of a coil are different. The overlapping description will be omitted for the convenience of description.

Referring to FIG. 4, a coil 213 in the coil component 200 may include a first coil 2131 on one side of a support member 212 and a second coil 2132 on the other side thereof. Each of the first coil 2131 and the second coil 2132 may have a stacked structure including a plurality of conductive layers.

A second conductive layer 2131*b* of the first coil 2131 is disposed on a first conductive layer 2131*a*. A line width W2 of the first conductive layer 2131*a*, a lowermost layer of the first coil 2131, is wider than a line width W1 of a third conductive layer 2131*c*, substantially determining a thickness of the first coil 2131, while a line width W3 of a fourth conductive layer 2132*a*, a lowermost layer of the second coil 2132, is wider than a line width w4 of a sixth conductive layer 2132*c*, substantially determining a thickness of the second coil.

Line widths of the first conductive layer 2131*a*, embedded in the support member 212, and the fourth conductive layer 2132*a*, a lowermost layer of the second coil 2132, are relatively wide, thereby increasing a degree of freedom in processing or alignment of an exposure device. Thus, short due to eccentricity or ultrafine pattern implementation may be easily performed. Moreover, the line width of the first conductive layer 2131*a*, embedded in the support member 212, is relatively wide, thereby reducing laser power of a $CO_2$ laser during removing the insulating wall having been patterned. Thus, loss of a resin in the support member 212 may be significantly reduced. As described above, the loss of a resin in the support member 212 is significantly reduced, so delamination of a coil, and the like, may be effectively prevented.

Figure 5:
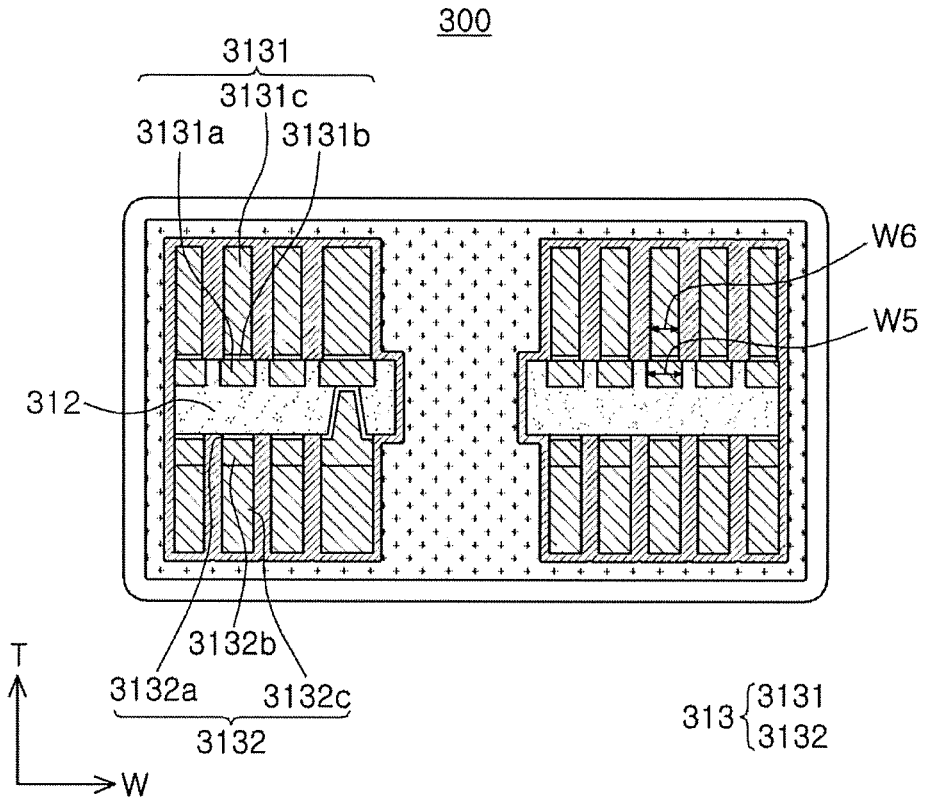
FIG. 5 is a cross-sectional view of an inductor according to a third example.

FIG. 5 is a schematic cross-sectional view of a coil component 300 according to a third example. The coil component 300 according to a third example may include components substantially the same as those of the coil component 100 according to the first example described with reference to FIGS. 1 and 2, except that line widths of respective layers of a coil are different. The overlapping description will be omitted for the convenience of description.

Referring to FIG. 5, a coil 313 in the coil component 300 may include a first coil 3131 on one side of a support member 312 and a second coil 3132 on the other side thereof. Each of the first coil and the second coil may have a stacked structure including a plurality of conductive layers.

A second conductive layer 3131*b* of the first coil 3131 is disposed on a first conductive layer 3131*a*. A line width W5 of the first conductive layer 3131*a*, a lowermost layer of the first coil 3131, is wider than a line width W6 of a third conductive layer 3131*c*, substantially determining a thickness of the first coil 3131. In this regard, the structure described above may be obtained by differentiating line widths of openings of insulating walls, having been patterned, when a first coil and a second coil are provided. The line width of the first conductive layer is wider than the line width of the third conductive layer, so loss or deformation of a surface of the support member may be significantly reduced. The structure of the second coil 3132 including fourth to sixth conductive layers 3132*a* to 3132*c* corresponds to that of the second coil 132. A description thereof will be omitted to avoid redundancy.

Figure 6:
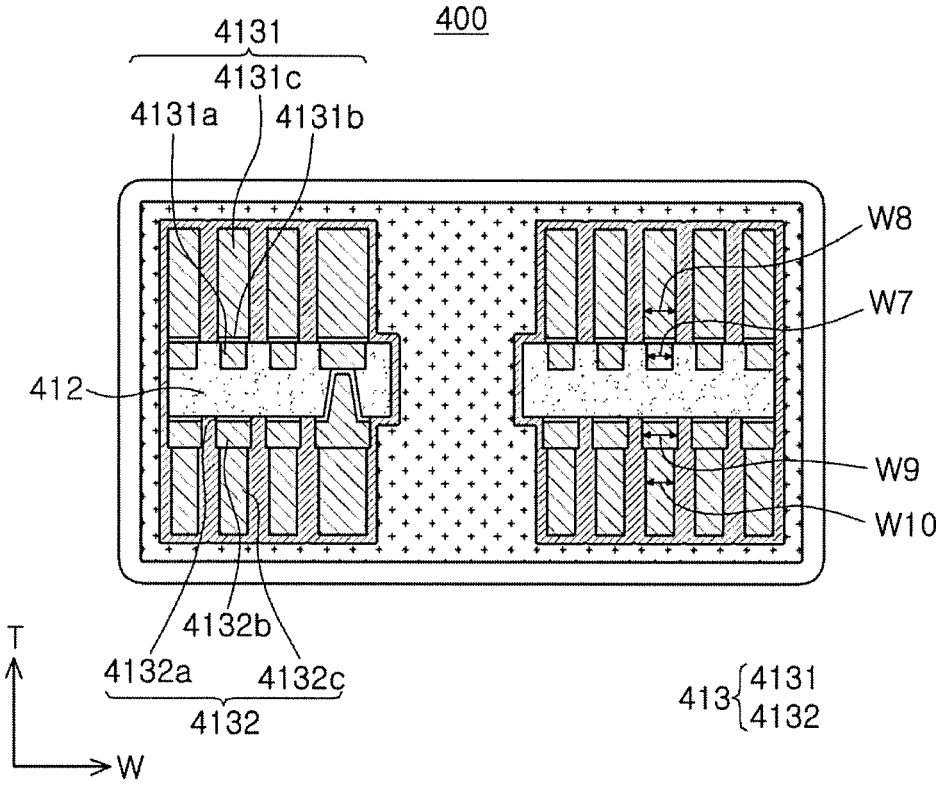
FIG. 6 is a cross-sectional view of an inductor according to a fourth example.

FIG. 6 is a schematic cross-sectional view of a coil component 400 according to a fourth example. The coil component 400 according to a fourth example may include components substantially the same as those of the coil component 100 according to the first example described with reference to FIGS. 1 and 2, except that line widths of respective layers of a coil are different. The overlapping description will be omitted for the convenience of description.

Referring to FIG. 6, a coil 413 in the coil component 400 may include a first coil 4131 on one side of a support member 412 and a second coil 4132 on the other side thereof. Each of the first coil 4131 and the second coil 4132 may have a stacked structure including a plurality of conductive layers.

A second conductive layer 4131*b* of the first coil 4131 is disposed on a first conductive layer 4131*a*. A line width W7 of the first conductive layer 4131*a*, a lowermost layer of the first coil 4131, is narrower than a line width W8 of a third conductive layer 4131*c*, substantially determining a thickness of the first coil 4131, while a line width W9 of a fourth conductive layer 4132*a*, a lowermost layer of the second coil 4132, is substantially wider than a line width W10 of a sixth conductive layer 4132*c*, determining a thickness of the second coil 4132. The line width of the fourth conductive layer is relatively wider than the line width of the sixth conductive layer, so a contact area between the second coil and the support member are increased. Thus, a phenomenon in which the second coil is flying from the support member may be prevented. Moreover, the line width of the third conductive layer is relatively wider than the line width of the first conductive layer, thereby implementing a structure in which the line width of the second conductive layer, disposed below the third conductive layer, is relatively wide. As a result, a contact area of one side of the support member, directly in contact with the second conductive layer, is significantly increased, so frying of a coil pattern, collapsing of a partition wall during a manufacturing process, or the like, may be prevented.

Figure 7:
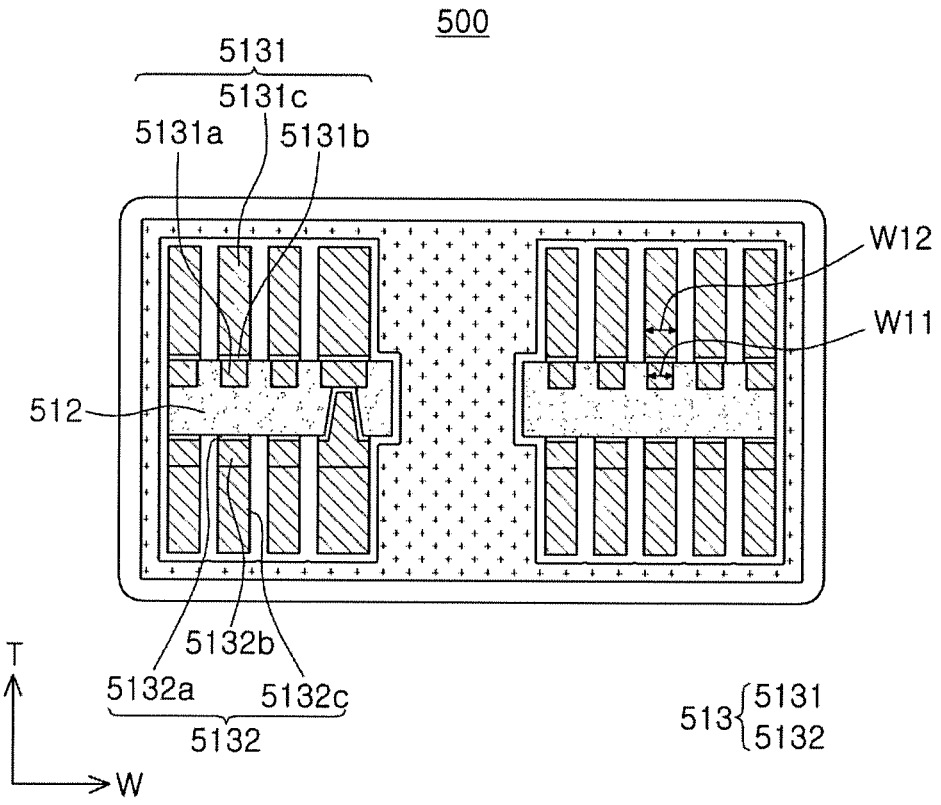
FIG. 7 is a cross-sectional view of an inductor according to a fifth example.

FIG. 7 is a schematic cross-sectional view of a coil component 500 according to a fifth example. The coil component 500 according to a fifth example may include components substantially the same as those of the coil component 100 according to the first example described with reference to FIGS. 1 and 2, except that line widths of respective layers of a coil are different. The overlapping description will be omitted for the convenience of description.

Referring to FIG. 7, a coil 513 in the coil component 500 may include a first coil 5131 on one side of a support member 512 and a second coil 5132 on the other side thereof. Each of the first coil and the second coil may have a stacked structure including a plurality of conductive layers.

A second conductive layer 5131*b* of the first coil 5131 is disposed on a first conductive layer 5131*a*. The line width W11 of the first conductive layer 5131*a*, a lowermost layer of the first coil 5131, is narrower than the line width W12 of the third conductive layer 5131*c*, substantially determining a thickness of the first coil 5131. In this regard, the structure described above may be obtained by differentiating line widths of openings of insulating walls, having been patterned, when a first coil and a second coil are provided. The structure of the second coil 5132 including fourth to sixth conductive layers 5132*a* to 5132*c* corresponds to that of the second coil 132. A description thereof will be omitted to avoid redundancy.

As set forth above, according to an exemplary embodiment, a thickness of a coil pattern is significantly increased in a limited size of a coil component, and a line width of a coil pattern is finer, so a coil component having improved direct current resistance (Rdc) characteristics may be provided.

While exemplary embodiments have been shown and described above, it will be apparent to those skilled in the art that modifications and variations could be made without departing from the scope of the present invention as defined by the appended claims.

What is claimed is:

1. A coil component, comprising:

a body including a support member having a through hole and a via hole, first and second coils disposed on a first side and a second side of the support member opposing the first side and having a plurality of coil patterns, respectively, and a magnetic material sealing the support member and the first and second coils; and an external electrode disposed on an exterior surface of the body, wherein the first coil includes at least a portion embedded in the support member, and the second coil is connected to the first coil through a via disposed in the via hole, the first side of the support member is provided with groove portions recessed toward a center of the support member according to a shape of the first coil, the groove portions are filled with a first conductive layer as a lowermost layer of the first coil, the second side of the support member is in contact with a lower surface of the second coil, an upper surface of the first conductive layer is coplanar to the first side of the support member, and a thickness of the first conductive layer is greater than a thickness of the second conductive layer.

2. The coil component of claim 1, wherein the first coil further includes a second conductive layer and a third conductive layer, stacked on the first conductive layer.

3. The coil component of claim 2, wherein a thickness of the second conductive layer is equal to or more than 50 nm and equal to or less than 1 μm.

4. The coil component of claim 2, wherein the second conductive layer includes one or more among molybdenum (Mo), aluminum (Al), nickel (Ni), and palladium (Pd).

5. The coil component of claim 2, wherein a line width of the first conductive layer is wider than a line width of the third conductive layer.

6. The coil component of claim 2, wherein a line width of the first conductive layer is narrower than a line width of the third conductive layer.

7. The coil component of claim 2, wherein a line width of the first conductive layer is equal to a line width of the third conductive layer.

8. The coil component of claim 1, wherein the second coil includes a fourth conductive layer in contact with the second side of the support member, and a fifth conductive layer and a sixth conductive layer, sequentially stacked on the fourth conductive layer.

9. The coil component of claim 8, wherein the fourth conductive layer includes one or more among Mo, Al, Ni, and Pd.

10. The coil component of claim 8, wherein a thickness of the fourth conductive layer is equal to or more than 50 nm and equal to or less than 1 μm.

11. The coil component of claim 8, wherein a line width of the fifth conductive layer of the second coil is wider than a line width of the sixth conductive layer.

12. The coil component of claim 8, wherein a line width of the fifth conductive layer of the second coil is equal to a line width of the sixth conductive layer.

13. The coil component of claim 1, wherein a cross-section of the groove portion has a quadrangular shape.

14. The coil component of claim 1, wherein at least a portion of a side surface of the via hole is covered by the second coil.

15. The coil component of claim 1, further comprising an insulating material covering a surface of each of the first coil and the second coil.

16. The coil component of claim 1, wherein the first conductive layer of the first coil is directly in contact with the support member.

17. The coil component of claim 1, wherein the support member includes an insulating material.

18. The coil component of claim 8, wherein a thickness of the fourth conductive layer is less than a thickness of the first conductive layer.

19. A coil component, comprising:

a body including a support member having a through hole and a via hole, first and second coils disposed on a first side and a second side of the support member opposing the first side and having a plurality of coil patterns, respectively, and a magnetic material sealing the support member and the first and second coils; and an external electrode disposed on an exterior surface of the body, wherein the first coil includes at least a portion embedded in the support member, and the second coil is connected to the first coil through a via disposed in the via hole, the first side of the support member is provided with groove portions recessed toward a center of the support member according to a shape of the first coil, the groove portions are filled with a first conductive layer as a lowermost layer of the first coil, the second side of the support member is in contact with a lower surface of the second coil, the first coil further includes a second conductive layer and a third conductive layer, sequentially disposed on the first conductive layer, the second coil includes a fourth conductive layer in contact with the second side of the support member, and a fifth conductive layer and a sixth conductive layer, sequentially disposed on the fourth conductive layer, a thickness of the first conductive layer is greater than a thickness of the second conductive layer and is less than a thickness of the third conductive layer, a thickness of the fifth conductive layer is greater than a thickness of the fourth conductive layer and is less than a thickness of the sixth conductive layer, and an upper surface of the first conductive layer is coplanar to the first side of the support member.

20. A coil component, comprising:

a body including a support member having a through hole and a via hole, first and second coils disposed on a first side and a second side of the support member opposing the first side and having a plurality of coil patterns, respectively, and a magnetic material sealing the support member and the first and second coils; and an external electrode disposed on an exterior surface of the body, wherein the first coil includes at least a portion embedded in the support member, and the second coil is connected to the first coil through a via disposed in an interior of the via hole, the first side of the support member is provided with groove portions recessed toward a center of the support member according to a shape of the first coil, the groove portions are filled with a first conductive layer as a lowermost layer of the first coil, the second side of the support member is in contact with a lower surface of the second coil, a width of the via hole increases in a direction from the first side to the second side, and an upper surface of the first conductive layer is coplanar to the first side of the support member.

* * * * *